US008361178B2

(12) United States Patent
Liu et al.

(10) Patent No.: US 8,361,178 B2
(45) Date of Patent: Jan. 29, 2013

(54) TUNGSTEN RHENIUM COMPOUNDS AND COMPOSITES AND METHODS FOR FORMING THE SAME

(75) Inventors: Qingyuan Liu, Provo, UT (US); Russell J Steel, Salem, UT (US); Scott Packer, Alpine, UT (US); Scott Horman, Lindon, UT (US)

(73) Assignee: Smith International, Inc., Houston, TX (US)

( * ) Notice: Subject to any disclaimer, the term of this patent is extended or adjusted under 35 U.S.C. 154(b) by 146 days.

(21) Appl. No.: 12/148,687

(22) Filed: Apr. 21, 2008

(65) Prior Publication Data

US 2009/0260299 A1 Oct. 22, 2009

(51) Int. Cl.
*C09K 3/14* (2006.01)

(52) U.S. Cl. ..... 51/309

(58) Field of Classification Search ..... 51/309; 75/228, 244, 245, 248
See application file for complete search history.

(56) References Cited

U.S. PATENT DOCUMENTS

| | | | | |
|---|---|---|---|---|
| 4,241,135 | A * | 12/1980 | Lee et al. | 428/332 |
| 4,985,051 | A * | 1/1991 | Ringwood | 51/309 |
| 5,476,531 | A | 12/1995 | Timm et al. | |
| 6,461,564 | B1 | 10/2002 | Dilmore et al. | |
| 6,521,173 | B2 | 2/2003 | Kumar et al. | |
| 6,551,377 | B1 | 4/2003 | Leonhardt | |
| 6,613,383 | B1 | 9/2003 | George et al. | |
| 6,635,362 | B2 | 10/2003 | Zheng | |
| 6,648,206 | B2 | 11/2003 | Nelson et al. | |
| 6,899,926 | B2 | 5/2005 | Narita et al. | |
| 6,911,063 | B2 | 6/2005 | Liu | |
| 7,032,800 | B2 | 4/2006 | Subramanian et al. | |
| 7,211,146 | B2 | 5/2007 | Schowalter | |
| 7,216,793 | B2 | 5/2007 | Stotler et al. | |
| 7,226,492 | B2 | 6/2007 | Mahot et al. | |
| 7,354,548 | B2 | 4/2008 | Liu | |
| 7,357,292 | B2 | 4/2008 | Tolle et al. | |
| 7,645,315 | B2 | 1/2010 | Liu | |
| 7,743,961 | B2 | 6/2010 | Maruko et al. | |
| 7,857,188 | B2 | 12/2010 | Liu | |
| 2002/0069592 | A1 * | 6/2002 | Sherman et al. | 51/309 |
| 2004/0134309 | A1 | 7/2004 | Liu | |
| 2005/0129565 | A1 | 6/2005 | Ohriner et al. | |
| 2005/0133122 | A1 | 6/2005 | Jackson et al. | |
| 2005/0148466 | A1 | 7/2005 | Lemmon et al. | |
| 2005/0191482 | A1 | 9/2005 | Liu | |
| 2007/0034416 | A1 * | 2/2007 | Cho et al. | 175/434 |
| 2008/0311420 | A1 | 12/2008 | Zillmer et al. | |
| 2010/0180514 | A1 | 7/2010 | Liu | |
| 2010/0258612 | A1 | 10/2010 | Kolbeck et al. | |
| 2010/0279146 | A1 | 11/2010 | Rowe et al. | |

FOREIGN PATENT DOCUMENTS

| | | | |
|---|---|---|---|
| WO | WO 99/52669 | | 10/1999 |
| WO | WO 2007/019581 | A2 | 2/2007 |
| WO | WO 2007/089882 | A2 | 8/2007 |
| WO | WO 2008/072180 | * | 6/2008 |

OTHER PUBLICATIONS

International Search Report and the Written Opinion of the International Searching Authority, or the Declaration, for International Application No. PCT/US2009/041299, Filed Apr. 21, 2009.

T. Liyanage et al.; *Friction Stir Spot Welding of AM60 Magnesium Alloy to DP600 Steel* (Report); 7 pages.

Colin J. Sterling; *Effects of Friction Stir Processing on the Microstructure and Mechancical Properties of Fusion Welded 304L Stainless Steel*(A thesis submitted to the faculty of Brigham Young University in partial fulfillment of the requirements for the degree of Master of Science); Department of Mechanical Engineering Brigham Young University; Aug. 2004; 7 pages.

R.S. Mishra, Z.Y. Ma; *Materials Science and Engineering R 50*; (2005) 1-78; 4 pages.

Tom Speller, Jr., John Perrelli and Wim Lam; *Friction Stir Weld (FSW ) Design of Experiments 1*, Tests Conducted on Nov. 19 and 20, 2001; 119 pages.

Carl D. Sorensen, *Progress in Friction Stir Welding High Temperature Materials, Friction Stir Research Laboratory*, Brigham Young University, ISOPE 2004, 42 pages.

TWI, 1st International Symposium on Friction Stir Welding, held at the Rockwell Science Center, Thousand Oaks, California, Jun. 14-16, 1999; http://www.twi.co.uk/content/fswsympl.html (website); Industrial Membership Professional Members Register; 5 pages.

T. J. Lienert (Los Alamos National Laboratory), W. Tang and J.A. Hogeboom (University of South Carolina), L.G. KVIDAHL (Northrop Grumman Ship Systems, Ingalls Operation); Friction Stir Welding of DH-36 Steel; 2 pages.

Yoshitsugu Suzuki, Search Report—Invalidity Search: US7032800 (equiv JP4721659B2), NGB Corporation; dated Dec. 21, 2011; 4 pages.

P. L. Threadgill; *A Review of Friction Stir Welding: Part 2, Selection of Tool Materials* (Research Report); The Welding Institute, Granta Park, Great Abington, Cambridge CBI 6AL, United Kingdom; Feb. 2003; 3 pages.

Shweta Dike; *Dynamic Deformation of Materials at Elevated Temperatures*(Thesis); Department of Mechanical and Aerospace Engineering; Case Western Reserve University; May 2010; 3 Pages.

*Primary Examiner* — Elizabeth Wood

(74) *Attorney, Agent, or Firm* — Christie, Parker & Hale, LLP

(57) ABSTRACT

The present invention relates to tungsten rhenium compounds and composites and to methods of forming the same. Tungsten and rhenium powders are mixed together and sintered at high temperature and high pressure to form a unique compound. An ultra hard material may also be added. The tungsten, rhenium, and ultra hard material are mixed together and then sintered at high temperature and high pressure.

32 Claims, 9 Drawing Sheets

TUNGSTEN RHENIUM COMPOUNDS AND COMPOSITES AND METHODS FOR FORMING THE SAME

FIELD OF THE INVENTION

The present invention relates to tungsten rhenium compounds and composites and to methods of forming the same.

BACKGROUND

Various hard materials and methods of forming hard materials have been used to form cutting tools as well as tools used for friction stir welding. A tool used for friction stir welding includes a hard metal pin that is moved along the joint between two pieces to plasticize and weld the two pieces together. Because this process wears greatly on the tool, hard and strong materials are very desirable. As a results, hard metal compounds and composites have been developed to improve wear resistance.

Prior art hard materials include a carbide, such as tungsten carbide, bound with a binder such as cobalt or rhenium. Carbide-based hard materials have been produced with rhenium as the only binder, using conventional sintering methods. Tungsten-rhenium alloys have also been produced with standard cementing methods. Such tungsten-rhenium alloys can be used as alloy coatings for high temperature tools and instruments. However, materials with improved wear resistance are desired for use in cutting tools such as cutting elements used in earth boring bits and in other tools such as friction stir welding tools.

SUMMARY OF THE INVENTION

The present invention relates to tungsten rhenium compounds and composites and more particularly to a method of forming the same. In one embodiment, a method of forming a tungsten rhenium composite at high temperature and high pressure is provided. Tungsten (W) and rhenium (Re) powders, which may be either blended, coated, or alloyed, are sintered at high temperature and high pressure to form a unique composite material, rather than simply alloying them together with conventional cementing processes.

In another embodiment, an ultra hard material is added to the W—Re composite to obtain a sintered body of an ultra hard material and W—Re with uniform microstructure. The tungsten, rhenium, and ultra hard material are sintered at high temperature and high pressure. The ultra hard material may be cubic boron nitride, diamond, or other ultra hard materials.

In the resulting composite material, the particles of the ultra hard material are uniformly distributed in the sintered body. The ultra hard material improves wear resistance of the sintered parts, while the high-melting W—Re binder maintains the strength and toughness at high temperature operations. The W—Re alloy binder gives desired toughness and improves high temperature performance due to its higher recrystallization temperature (compared to W or Re alone). The ultra hard material also forms a strong bond with the W—Re matrix.

In one embodiment, a method of forming a material includes providing tungsten and rhenium and sintering the tungsten and rhenium at high temperature and high pressure. The high temperature can fall within the range of 1000° C. to 2300° C., and the high pressure can fall within the range of 20 to 65 kilobars. The method can also include sintering an ultra hard material with the tungsten and rhenium at high temperature and high pressure.

In one embodiment, a high pressure high temperature sintered binder includes tungsten, wherein the tungsten is within the range of approximately 50% to approximately 99% of the volume of the binder, and rhenium, wherein the rhenium is within the range of approximately 50% to approximately 1% of the volume of the binder.

In another embodiment, a composite material includes the binder just described and an ultra hard material, such as diamond or cubic boron nitride. The ultra hard material bonds with the W—Re matrix to form a polycrystalline composite material.

DETAILED DESCRIPTION OF THE INVENTION

The present invention relates to tungsten rhenium compounds and composites and more particularly to a method of forming the same at high temperature and high pressure. In one embodiment, a method of forming a tungsten rhenium composite at high temperature and high pressure is provided. Tungsten (W) and rhenium (Re) powders are sintered at high pressure and high temperature (HPHT sintering) to form a unique composite material, rather than simply alloying them together with conventional cementing or conventional sintering processes.

In an exemplary embodiment, the W—Re mixture is introduced into an enclosure, known as a "can" typically formed from niobium or molybdenum. The can with the mixture is then placed in a press and subjected to high pressure and high temperature conditions. The elevated pressure and temperature conditions are maintained for a time sufficient to sinter the materials. After the sintering process, the enclosure and its contents are cooled and the pressure is reduced to ambient conditions.

In exemplary embodiments of the present invention, the W—Re composite is formed by HPHT sintering, as contrasted from conventional sintering. In HPHT sintering, the sintering process is conducted at very elevated pressure and temperature. In some embodiments, the temperature is within the range from approximately 1000° C. to approximately 1600° C., and the pressure is within the range from approximately 20 to approximately 65 kilobars. In other embodiments, the temperature reaches 2300° C. As explained more fully below, HPHT sintering results in chemical bonding between the sintered materials, rather than simply fixing the hard particles in place by melting the binder around the hard particles.

In an exemplary embodiment, the tungsten and rhenium materials are obtained in powder form and are combined to form a mixture prior to sintering. The relative percentages of tungsten and rhenium in the mixture can vary depending on the desired material properties. In one embodiment, the compound includes approximately 25% or lower rhenium, and approximately 75% or higher tungsten. These percentages are measured by volume.

Figure 8A:
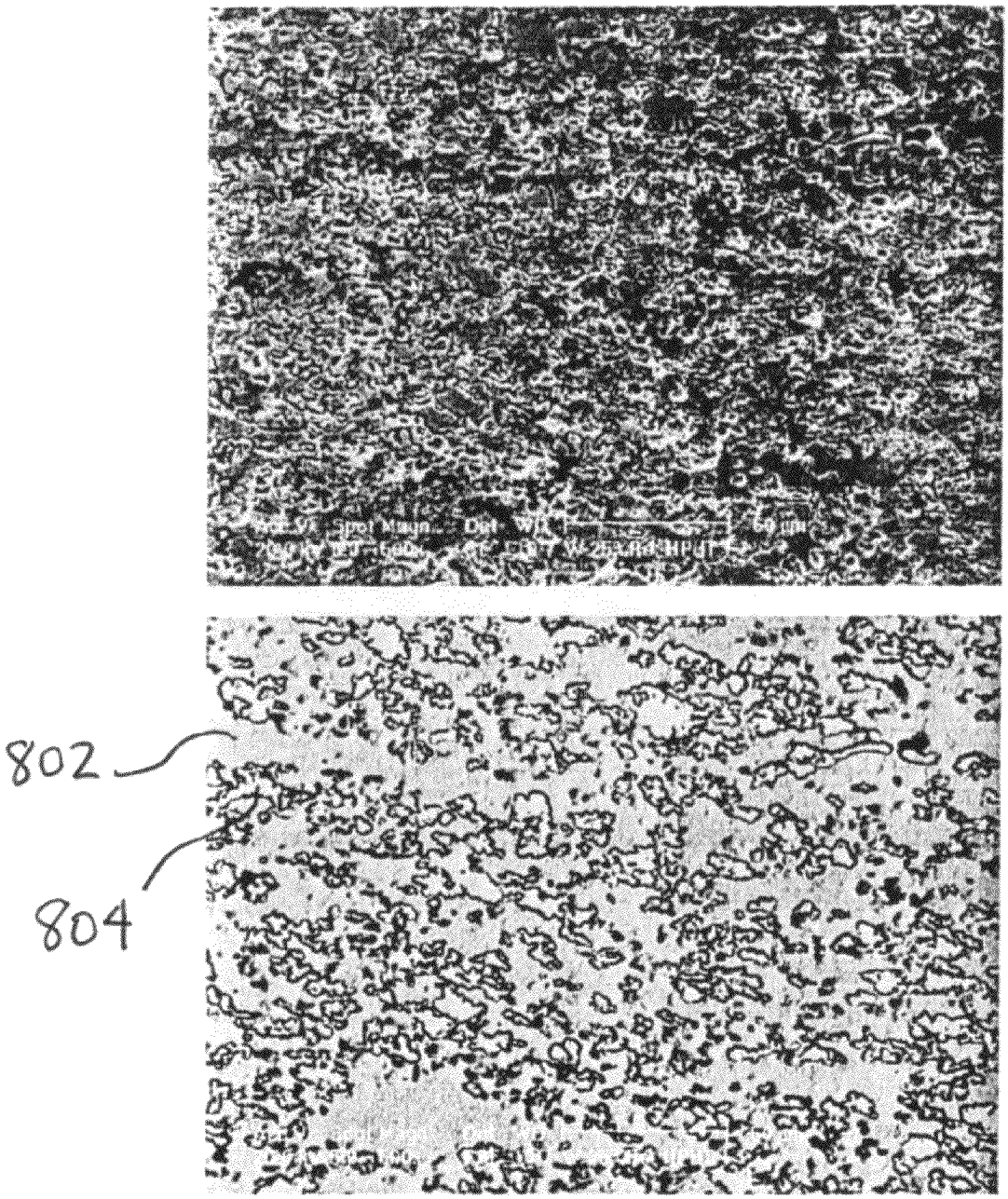
FIG. 8A is a photo reproduction of a scanning electron microscope image of a W—Re composite sintered at 1200° C.
Figure 8B:
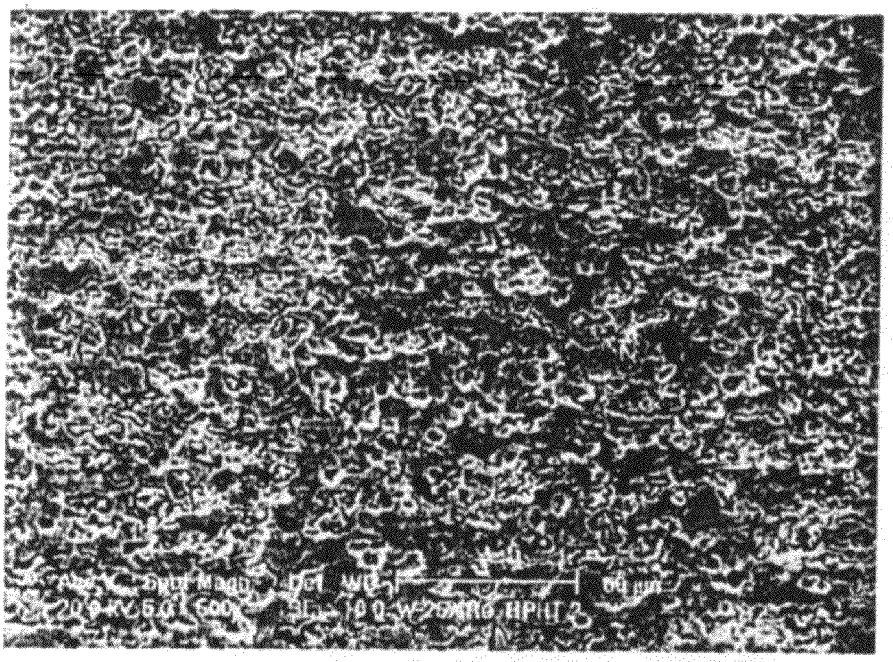
FIG. 8B is a photo reproduction of a scanning electron microscope image of a W—Re composite sintered at 1400° C.
Figure 8B:
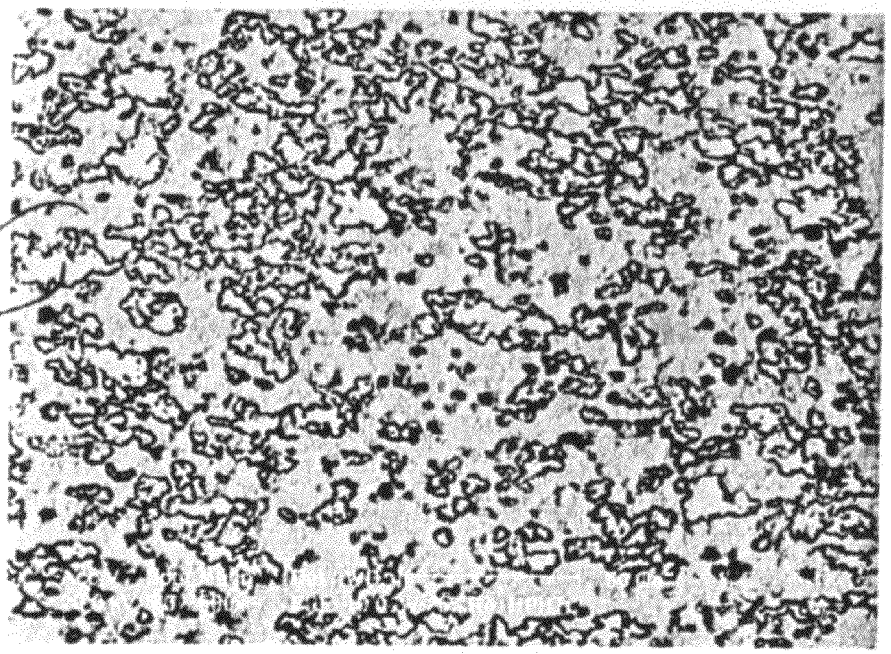

Examples of the resulting W—Re composite material formed by HPHT sintering are shown in FIGS. 8A and 8B. FIG. 8A shows a W—Re composite sintered at 1200° C., and FIG. 8B shows a W—Re composite sintered at 1400° C. The images show the tungsten particles 802 bonded to the rhenium particles 804.

In the resulting W—Re composite material formed by HPHT sintering, the rhenium provides improved toughness and strength at high temperature. The W—Re compound has a higher recrystallization temperature than either tungsten or rhenium alone, leading to improved high temperature performance. For example, when the composite material is used to manufacture a friction stir welding tool, the tool can weld across a longer distance as compared with prior art friction stir welding tools formed with traditional W—Re alloys or tungsten carbides. The improved high temperature performance of the W—Re composite provides improved wear resistance. The HPHT sintering also creates a material with higher density compared to conventional sintering.

In another embodiment, an ultra hard material is added to the W—Re matrix, and the mixture is HPHT sintered to form a composite of the ultra hard material and W—Re with uniform microstructure. The tungsten, rhenium, and ultra hard material are mixed together and then sintered at high temperature and high pressure to form a polycrystalline ultra hard material. The ultra hard material may be cubic boron nitride (CBN), diamond, diamond-like carbon, other ultra hard materials known in the art, or a combination of these materials.

In exemplary embodiments, the ultra hard material is mixed with the tungsten and rhenium with the relative proportions being approximately 50% ultra hard material and 50% W—Re by volume. The W—Re mixture is typically 25% or lower Re. However, this ratio is very flexible, and the percentage of Re compared to W may be varied from 50% to 1%. In addition, the percentage of ultra hard material may be varied from 1% to 99%. The mixture is then sintered at high temperature and high pressure, as described above, forming a polycrystalline ultra hard composite material. The resulting polycrystalline composite material includes the polycrystalline ultra hard material bound by the tungsten-rhenium binder alloy.

Tests were conducted on three different W—Re composites with cubic boron nitride (CBN) as the ultra hard material. All composites included 50% ultra hard material and 50% W—Re by volume. The first CBN W—Re composite 100 (referenced in FIG. 1 and Table 1 below) included cubic boron nitride as the ultra hard material. The cubic boron nitride had a size range of 2-4 microns. The second CBN W—Re composite 200 and third CBN W—Re composite 300 also included cubic boron nitride, but with a size range of 12-22 microns. The third composite also included 1% of aluminum by weight. These mixtures were each mixed in powder form for 30 minutes. The first two composites were then pressed at two different press temperatures, 1200° C. and 1400° C., and the third was pressed at 1400° C.

The resulting hardness of these composites was found to be the following:

TABLE 1

| | Press Temperature (° C.) | | | | |
|---|---|---|---|---|---|
| | 1200 | | 1400 | | |
| CBN Grade (μm) | 2-4 | 12-22 | 2-4 | 12-22 | 12-22 (w/ Al addition) |
| Hardness ($kg/mm^2$) | 1235 | 1236 | 1263 | 1188 | 1335 |
| | 1230 | 1219 | 1252 | 1126 | 1340 |
| | 1229 | 1202 | 1260 | 1192 | 1337 |

For comparison, the hardness of a conventional alloyed W—Re rod is 430 to 480 $kg/mm^2$, and conventional sintered W—Re is 600 to 650 $kg/mm^2$. Accordingly, the W—Re composite with 50% ultra hard material by volume showed a two to three-fold increase in hardness compared to conventional sintered W—Re and commercial W—Re rods. At the higher temperature, the coarser grade CBN showed a slightly lower hardness than the finer grade. The third composite with the addition of aluminum showed the highest hardness.

The aluminum was added to the third composite in order to provide a reaction with the nitrogen from the cubic boron nitride. When the materials in the third composite are sintered at high temperature and high pressure, the boron reacts with the rhenium to form rhenium boride. The remaining nitrogen can then react with the aluminum that has been added to the mixture.

The densities of these composites were found to be the following:

TABLE 2

| | Press Temperature (° C.) | | | | |
|---|---|---|---|---|---|
| | 1200 | | 1400 | | |
| CBN Grade (μm) | 2-4 | 12-22 | 2-4 | 12-22 | 12-22 (w/ Al addition) |
| Measured ($g/cm^3$) | 11.476 | 11.473 | 11.443 | 11.456 | 11.171 |
| Theoretical ($g/cm^3$) | 11.59 | | | | 11.23 |
| Ratio | 99.0% | 99.0% | 98.7% | 98.8% | 99.5% |

The ratios given above are the ratio of the measured density to the theoretical density. For comparison, a commercial W—Re rod has a theoretical density of 19.455 $g/cm^3$ and a ratio of 98.8%, and sintered W—Re has a theoretical density of 19.36 $g/cm^3$ and a ratio of 98.3%. Thus, these tests results showed that the HPHT sintered W—Re composite with CBN achieved higher densities than conventional sintered W—Re.

Figure 1A:
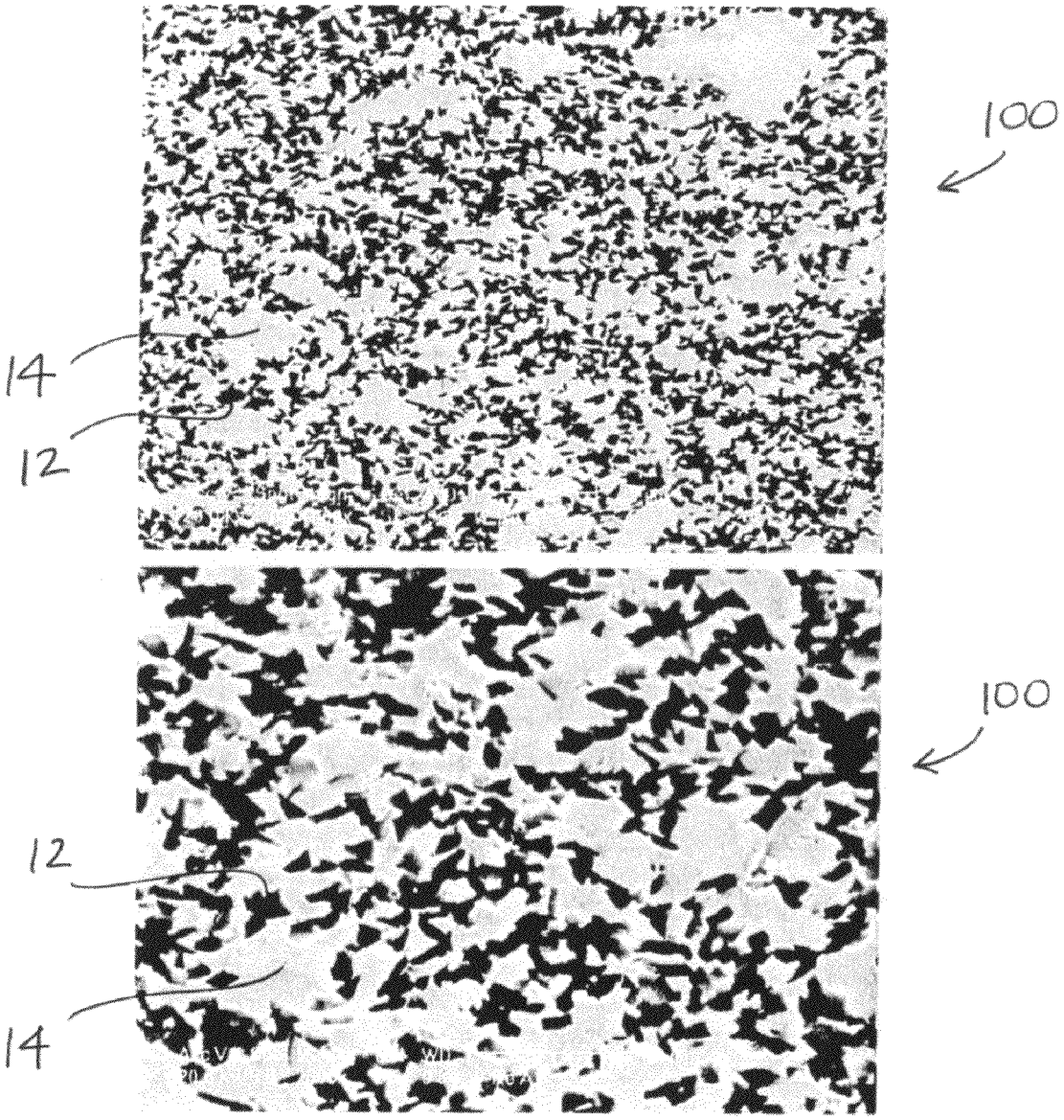
FIG. 1A is a photo reproduction of a scanning electron microscope image, at two different magnifications, of a W—Re composite with cubic boron nitride (CBN), sintered at 1200° C.
Figure 1B:
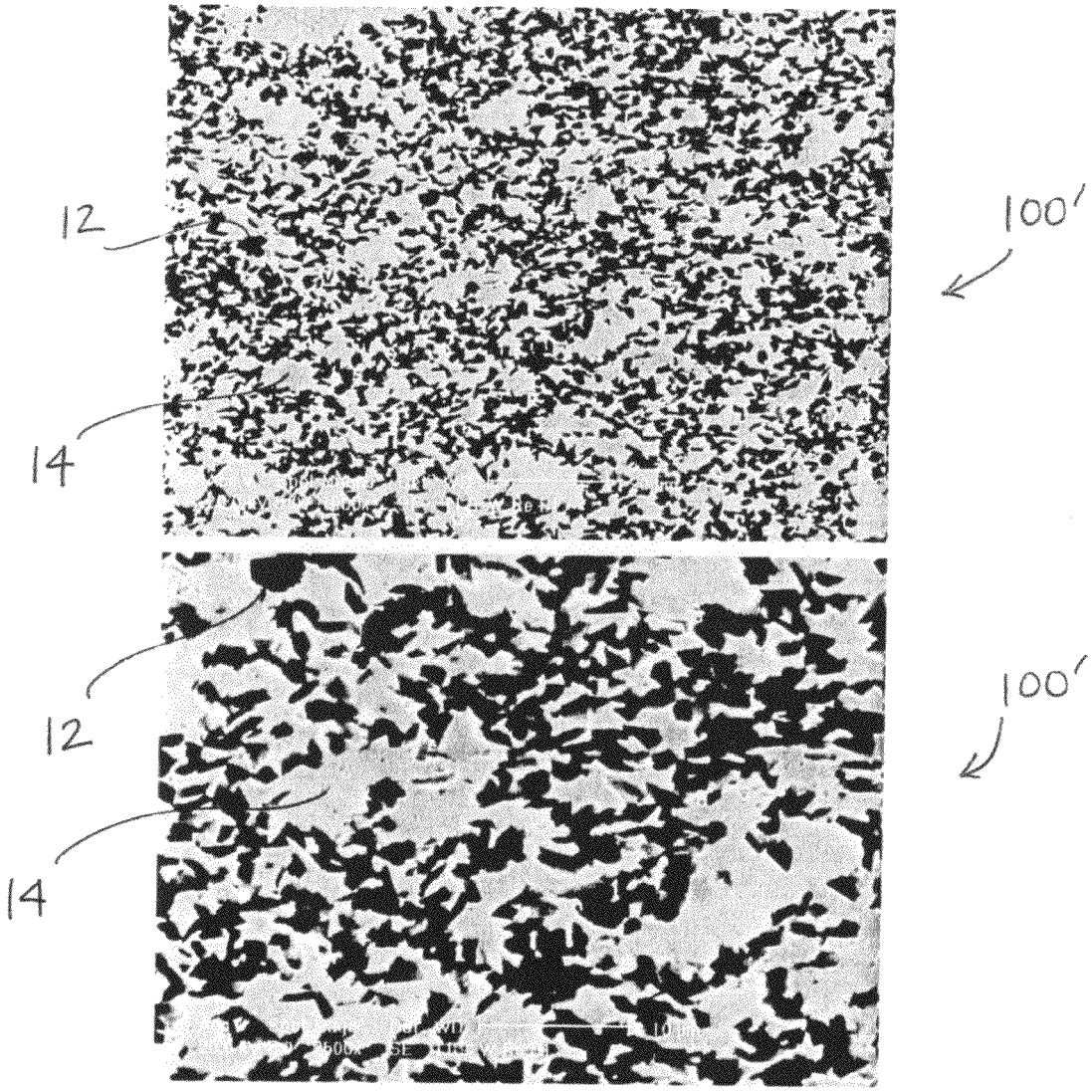
FIG. 1B is a photo reproduction of a scanning electron microscope image, at two different magnifications, of a W—Re composite with CBN, sintered at 1400° C.
Figure 2A:
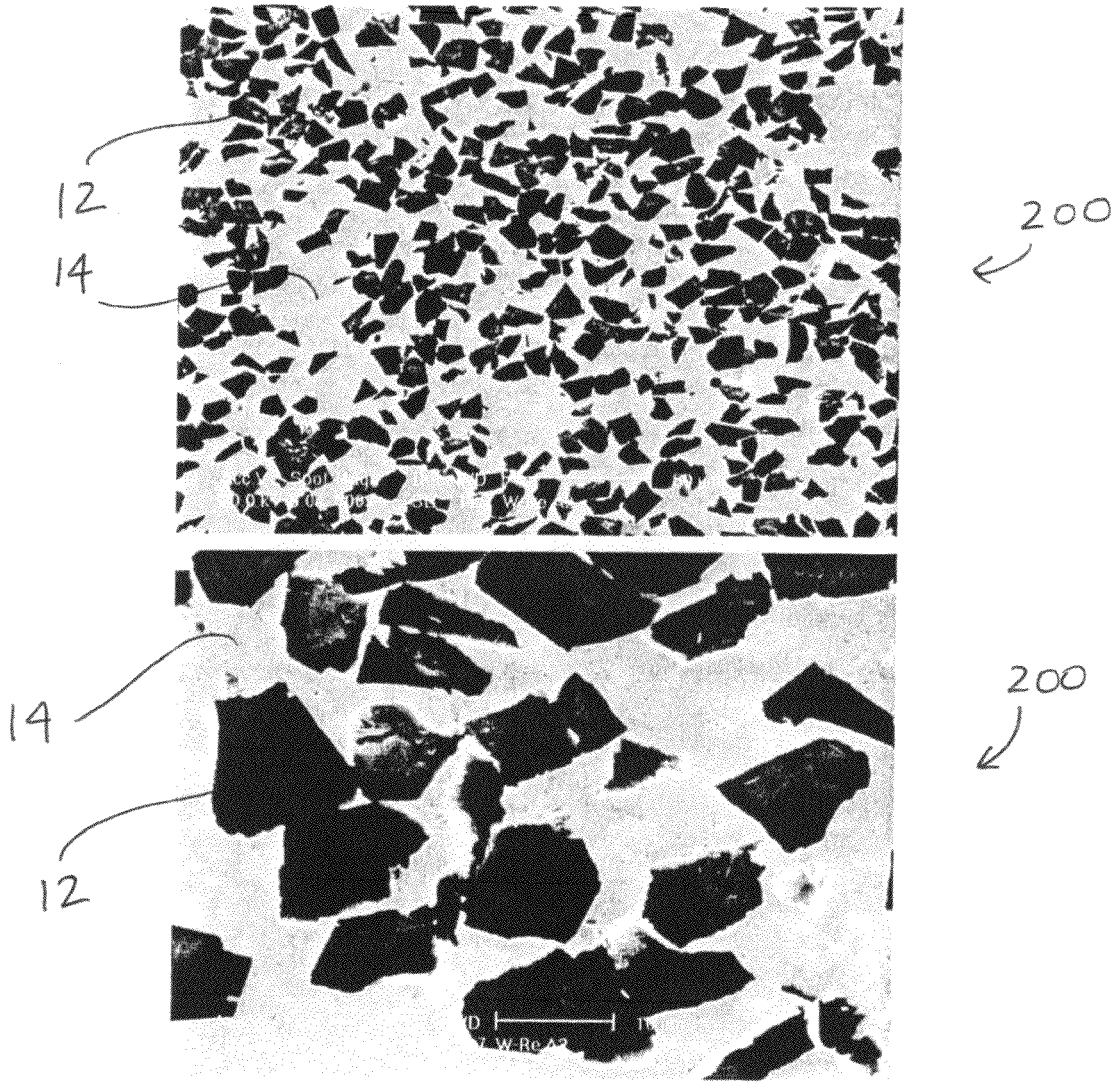
FIG. 2A is a photo reproduction of a scanning electron microscope image, at two different magnifications, of a W—Re composite with CBN, sintered at 1200° C.
Figure 2B:
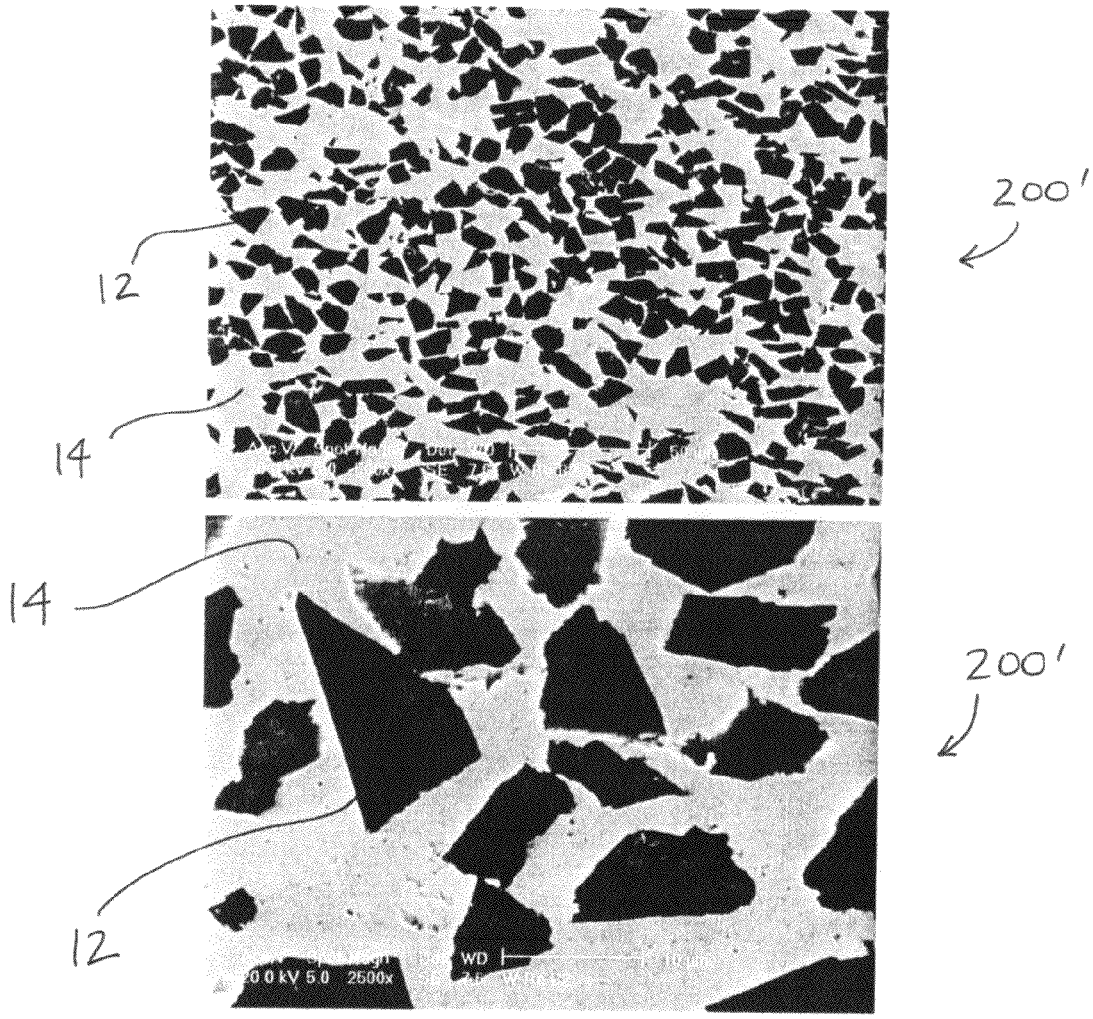
FIG. 2B is a photo reproduction of a scanning electron microscope image, at two different magnifications, of a W—Re composite with CBN, sintered at 1400° C.
Figure 3:
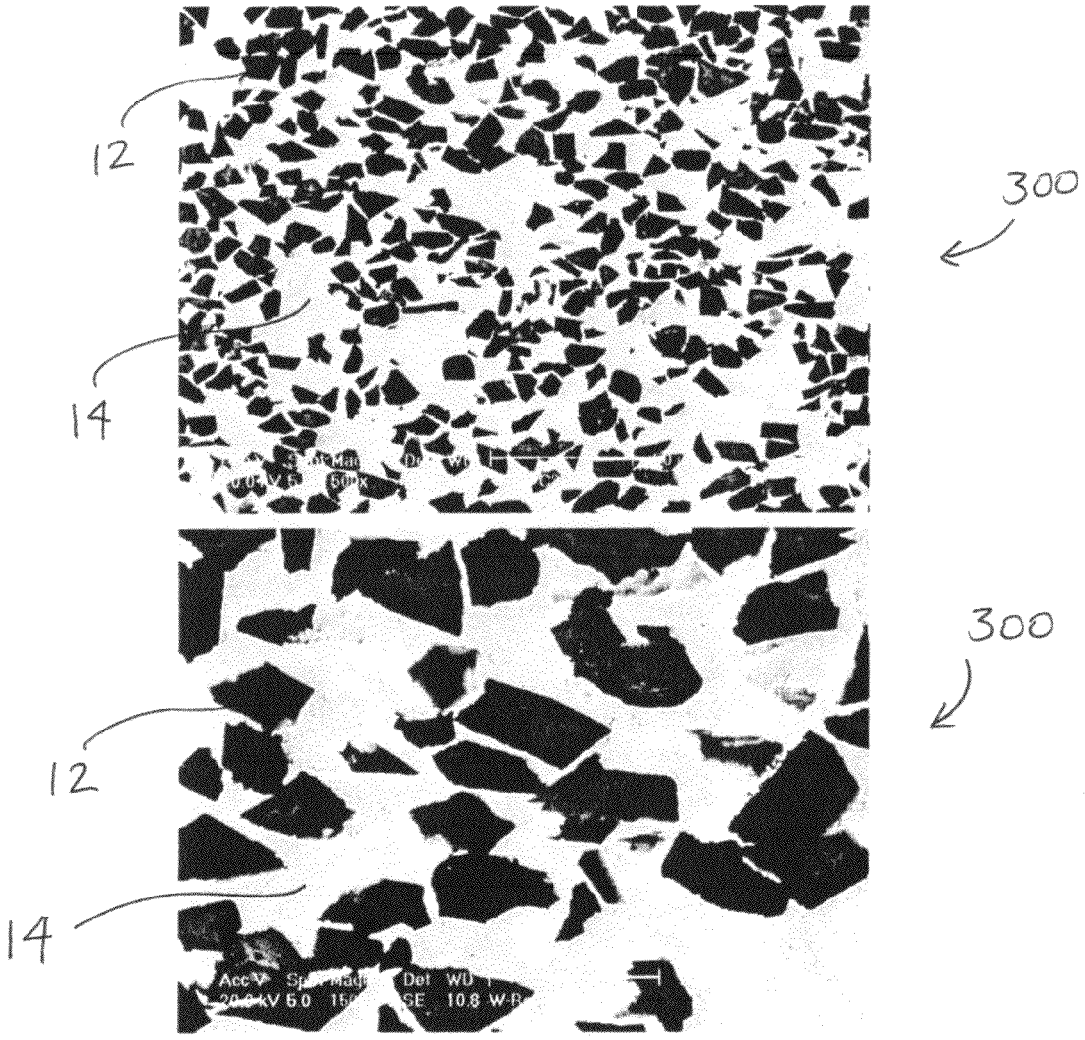
FIG. 3 is a photo reproduction of a scanning electron microscope image, at two different magnifications, of a W—Re composite with CBN and aluminum, sintered at 1400° C.

The microstructures of the three CBN W—Re composites are shown in FIGS. 1-3. FIG. 1A shows the first composite 100 pressed at 1200° C., at two magnifications, and FIG. 1B shows the first composite 100' pressed at 1400° C., at two magnifications. FIG. 2A shows the second composite 200 pressed at 1200° C., and FIG. 2B shows the second composite 200' pressed at 1400° C. FIG. 3 shows the third composite 300, which was pressed at 1400° C.

In all of the composites 100, 100', 200, 200', 300, the microstructure showed a uniform dispersion of the ultra hard materials 12 in the W—Re matrix 14, and uniform distribution of the aluminum in the third composite. Also, no significant pull-out was observed after polishing, giving an indication of good bonding between the CBN and the W—Re matrix. That is, when the composite was polished, the ultra hard particles were not pulled out of the matrix to leave gaps or holes. High contrast imaging of the composite revealed the existence of different W—Re grains, possibly including grains of W—Re intermetallic compound. Analysis also showed that in the third composite, the aluminum was uniformly distributed in the matrix.

Figure 7:
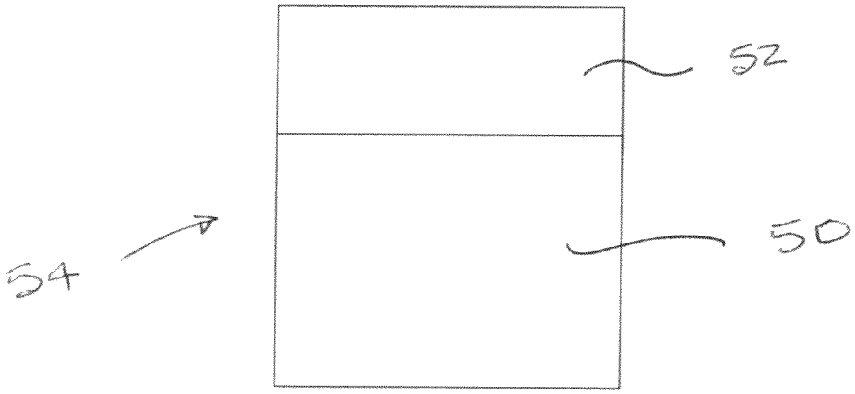
FIG. 7 is a front elevational view of a W—Re composite bonded onto a substrate.

Possible explanations for the strengthened material include good sintering of the W—Re matrix, strong bonding at the interface between the W—Re and ultra hard material through reactive sintering, alloying of the W—Re matrix, and the formation of aluminum oxide ($Al_2O_3$). The ultra hard material improves the wear resistance of the sintered parts, while the high-melting W—Re binder maintains the strength and toughness at high temperature operations. This composite material may be used for various tools such as friction stir welding tools. It could also be bonded onto a substrate 50 such as tungsten carbide, to form a cutting layer 52 of a cutting element 54, as for example shown in FIG. 7, which may be mounted on an earth boring bit.

Unlike materials produced with conventional sintering or cementing, the above-described HPHT composites form a solid chemical bond between the matrix and the cubic boron nitride particles. The boron from the cubic boron nitride reacts with the rhenium from the W—Re matrix, creating a strong bond between the matrix and the hard particles. This cubic boron nitride composite does not simply produce a material with hard particles dispersed inside a melted matrix, but instead produces a composite material with solid chemical bonding between the hard particles and the matrix. The bonding mechanism between the particles of ultra hard material and binder may vary depending on the ultra hard material used.

Figure 4:
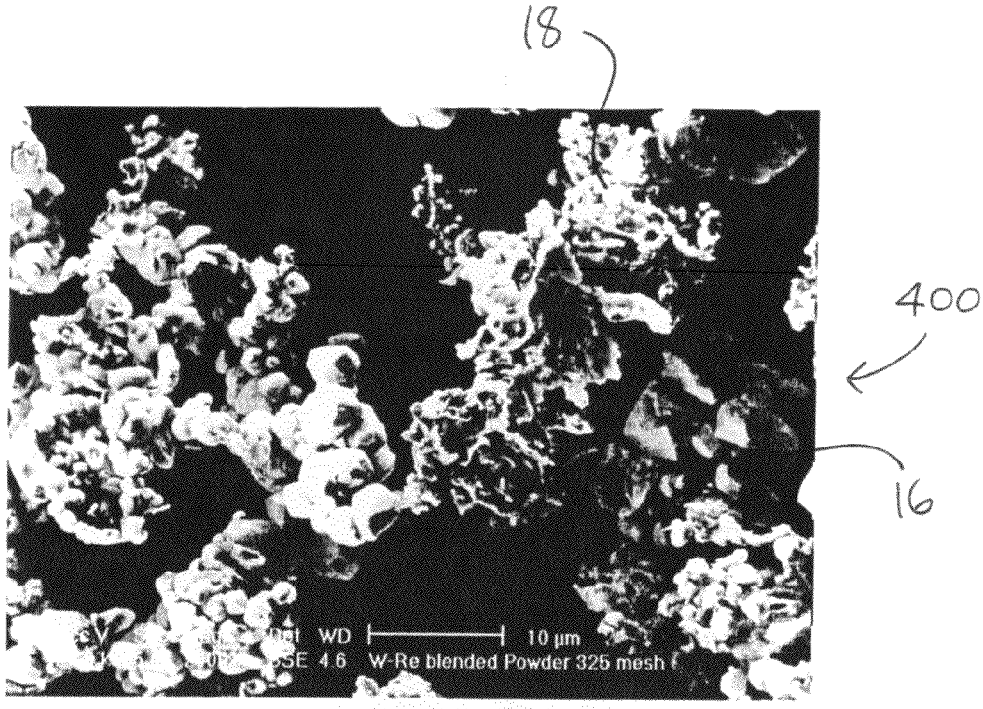
FIG. 4 is a photo reproduction of a scanning electron microscope image of a mixture of W—Re powder.

Tests were also conducted on a W—Re composite with diamond added as the hard material. The raw materials for this mixture were diamond particles (6-12 micrometers in size) and a blended W—Re powder 400. The blended W—Re powder 400 is shown in FIG. 4, which shows the W (numeral 16) and Re (numeral 18) components. The diamond particles and the W—Re powder were mixed together, 50% each by volume, for 30 minutes. The mixed materials were placed in a cubic press and HPHT sintered at 1400° C.

The resulting composite material displayed a very high hardness of 2700 kg/mm$^2$. For comparison, the W—Re composites with CBN materials (discussed above) ranged in hardness between 1200 and 1400 kg/mm$^2$, and the HPHT W—Re alone had a hardness of about 600-650 kg/mm$^2$.

Figure 5:
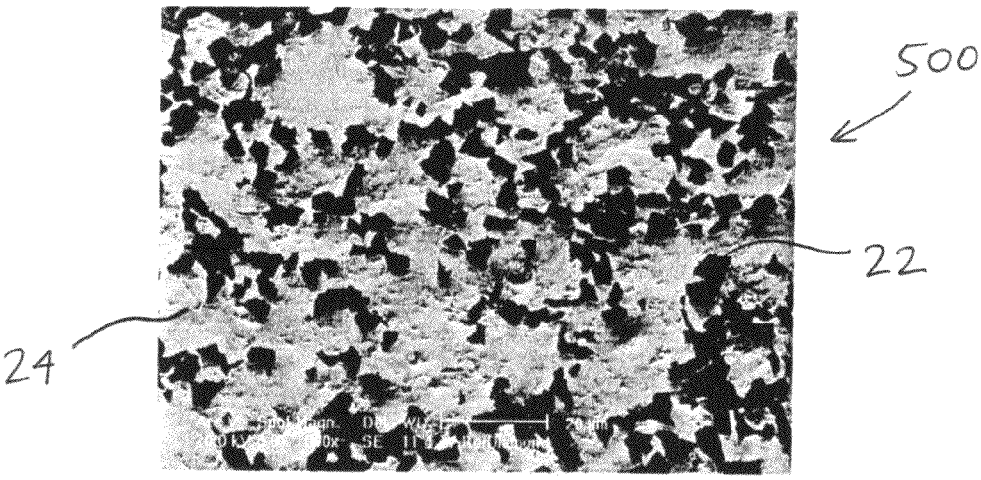
FIG. 5 is a photo reproduction of a scanning electron microscope image of a W—Re composite with diamond, sintered at 1400° C.

FIG. 5 shows the resulting microstructure of the diamond W—Re composite 500. The diamond particles 22 are evenly dispersed within the W—Re matrix 24. No significant pull-out was observed after polishing, giving an indication of good bonding between the diamond and the W—Re matrix. The resulting composite showed excellent sintering of the W—Re matrix.

Figure 6:
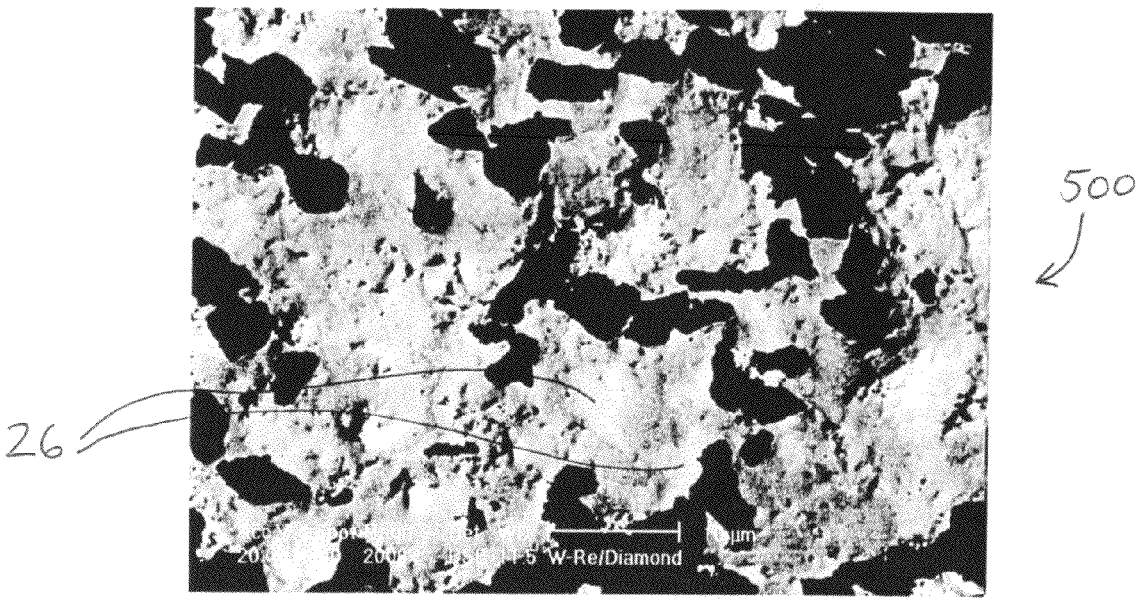
FIG. 6 is a photo reproduction of a backscattered electron image of the composite of FIG. 5.

FIG. 6 shows a backscattered electron image of the diamond W—Re composite. This image is able to differentiate the Re-rich regions 26.

Analysis of the diamond W—Re composite 500 confirmed that the HPHT sintering resulted in the formation of tungsten carbide. The carbon from the diamond reacted with the tungsten in the W—Re binder to produce tungsten carbide, which gives the composite a high hardness. The reaction between the carbon and tungsten to produce tungsten carbide is indicative of strong bonding between the hard particles and the W—Re matrix. This reaction is unique over prior art alloys, and it provides a material that has a high hardness due to the tungsten carbide and diamond, while still retaining ductility and high-temperature performance from the W—Re binder. The tungsten carbide gives the composite high hardness, but it can also be very brittle. The composite material retains ductility due to the W—Re matrix, which is more ductile than the tungsten carbide. The W—Re composite also has a higher recrystallization temperature than either tungsten or rhenium alone, leading to improved high temperature performance. Thus, the composite material formed of the hard, brittle tungsten carbide and ductile W—Re matrix is hard and ductile and performs very well at high temperature. The composite material can take advantage of the hardness of the diamond particles and the ductility of the high-melting W—Re matrix.

A layer of Niobium was apparent on the outer surface of the W—Re diamond composite after sintering, indicating a reaction between the Niobium from the can and carbon to form a layer of NbC on the outer surfaces of the composite which faced the Niobium can placed in the press.

In another embodiment, the rhenium is replaced by molybdenum, so that tungsten, molybdenum, and (optionally) an ultra hard material are mixed together and then sintered at high temperature and high pressure. As before, the ultra hard material could be cubic boron nitride (CBN), diamond, diamond-like carbon, or other ultra hard materials known in the art.

In yet another embodiment, the rhenium is replaced by lanthanum, so that tungsten, lanthanum, and (optionally) an ultra hard material are mixed together and then sintered at high temperature and high pressure.

Although limited exemplary embodiments of the HPHT sintered W—Re composite material and method have been specifically described and illustrated herein, many modifications and variations will be apparent to those skilled in the art. Accordingly, it is to be understood that the compositions and methods of this invention may be embodied other than as specifically described herein. The invention is also defined in the following claims.

What is claimed is:

1. A method of forming a material, comprising:

mixing an ultra hard material with tungsten and rhenium forming a mixture; and high pressure and high temperature sintering the mixture at a temperature not less than approximately 1000° C. and a pressure not less than approximately 20 kilobars to form a polycrystalline ultra hard material having ultra hard particles dispersed in a tungsten-rhenium matrix.

2. The method of claim 1, wherein the temperature is within the range of approximately 1000° C. to approximately 2300° C.

3. The method of claim 1, wherein the pressure is within the range of approximately 20 kilobars to approximately 65 kilobars.

4. The method of claim 3 wherein the temperature is within the range of approximately 1000° C. to approximately 2300° C.

5. The method of claim 4, wherein the ultra hard material is selected from the group consisting of cubic boron nitride, diamond, and diamond-like carbon.

6. The method of claim 4, wherein the ultra hard material is approximately 50% or greater of the volume of the material, and the rhenium and tungsten are approximately 50% or lower of the volume of the material.

7. The method of claim 4, wherein the sintering the mixture comprises forming a chemical bond between the ultra hard material and at least one of the tungsten or rhenium.

8. The method of claim 7, wherein the ultra hard material is cubic boron nitride, and wherein the forming a chemical bond comprises forming a chemical bond between at least a portion of the boron and at least a portion of the rhenium.

9. The method of claim 7, wherein the ultra hard material is diamond, and wherein the forming a chemical bond comprises forming a chemical bond between at least a portion of the diamond and at least a portion of the tungsten.

10. The method of claim 4, wherein a ratio of tungsten to rhenium by volume is approximately 3:1.

11. The method of claim 4, further comprising providing a substrate, wherein sintering comprises sintering the tungsten, rhenium and the substrate.

12. A polycrystalline composite material comprising:

tungsten-rhenium matrix; and a polycrystalline ultra hard material dispersed in said matrix and bonded to at least one of the tungsten or the rhenium, wherein said composite material is formed by high pressure high temperature sintering at a pressure within the range of approximately 20 kilobars to approximately 65 kilobars and a temperature within the range of approximately 1000° C. to approximately 2300° C.

13. The material of claim 12 wherein the tungsten is within the range of approximately 50% to approximately 99% of the volume of the matrix, and wherein the rhenium is within the range of approximately 50% to approximately 1% of the volume of the matrix.

14. The material of claim 13, wherein the ultra hard material makes up approximately 50% or higher of the volume of the polycrystalline composite material.

15. The material of claim 13, wherein the rhenium is approximately 25% of the volume of the matrix.

16. The material of claim 13, wherein the ultra hard material is cubic boron nitride, and wherein at least a portion of the boron is chemically bonded to the rhenium.

17. The material of claim 13, wherein the ultra hard material is diamond, and wherein at least a portion of the diamond is chemically bonded to the tungsten.

18. The material of claim 12 wherein said tungsten, rhenium and ultra hard material define a polycrystalline ultra hard material layer and wherein the composite material further comprises a substrate bonded to said polycrystalline ultra hard material layer.

19. The method of claim 1, wherein mixing comprises mixing said ultra hard material with a mixture of tungsten and rhenium.

20. The method of claim 19, wherein the mixture of tungsten and rhenium is a compound of tungsten and rhenium.

21. The method of claim 19, wherein the mixture of tungsten and rhenium comprises 25% by volume or less rhenium and 75% or more tungsten by volume.

22. The method of claim 19, wherein the mixture of ultra hard material and tungsten and rhenium comprises 50% ultra hard material by volume and 50% of the mixture of tungsten and rhenium by volume.

23. The method of claim 21, wherein the mixture of ultra hard material and tungsten and rhenium comprises 50% or more ultra hard material by volume and 50% or less of the mixture of tungsten and rhenium by volume.

24. The method of claim 19, wherein the mixture of tungsten and rhenium comprises 50% or less rhenium by volume and 50% or more tungsten by volume.

25. The method of claim 24, wherein the mixture of ultra hard material and tungsten and rhenium comprises from 1% to 99% ultra hard material by volume and from 1% to 99% of the mixture of tungsten and rhenium by volume.

26. The method of claim 1, further comprising mixing aluminum with said ultra hard material, tungsten and rhenium.

27. The method of claim 26, wherein the ultra hard material is cubic boron nitride.

28. The material of claim 12, wherein the ultra hard material is cubic boron nitride and wherein the material further comprises aluminum.

29. The material of claim 12, wherein the ultra hard material is cubic boron nitride and wherein the material further comprises $Al_2O_3$.

30. A polycrystalline cubic boron nitride composite material comprising:

tungsten-rhenium matrix formed from a mixture of tungsten and rhenium comprising 25% or less rhenium by volume and 75% or more tungsten by volume;

aluminum dispersed in said matrix; and a polycrystalline cubic boron nitride dispersed in said matrix and bonded to at least one of the tungsten or the rhenium, wherein said composite material is formed by high pressure high temperature sintering at a pressure within the range of approximately 20 kilobars to approximately 65 kilobars and a temperature within the range of approximately 1000° C. to approximately 2300° C.

31. The material of claim 30, wherein said aluminum is in the form of $Al_2O_3$.

32. The material of claim 30, wherein the aluminum is about 1% of the material by weight.

* * * * *

UNITED STATES PATENT AND TRADEMARK OFFICE

CERTIFICATE OF CORRECTION

PATENT NO. : 8,361,178 B2
APPLICATION NO. : 12/148687
DATED : January 29, 2013
INVENTOR(S) : Qingyuan Liu et al.

It is certified that error appears in the above-identified patent and that said Letters Patent is hereby corrected as shown below:

In the Claims

Column 8, Claim 22, line 12 Delete "19" Insert -- 21 --

Signed and Sealed this
Fifteenth Day of October, 2013

Teresa Stanek Rea
*Deputy Director of the United States Patent and Trademark Office*